US011174607B2

(12) United States Patent
Vetrucci et al.

(10) Patent No.: US 11,174,607 B2
(45) **Date of Patent: *Nov. 16, 2021**

(54) APPARATUS FOR COLLECTING GARBAGE AND DEBRIS FOR A MOTOR-SWEEPER

(71) Applicant: NILFISK A/S, Broendby (DK)

(72) Inventors: Giancarlo Vetrucci, Fiorenzuola D'Arda (IT); Alfonso Colletti, Rottofreno (IT); David Wood, Delano, MN (US)

(73) Assignee: NILFISK A/S, Broendby (DK)

( * ) Notice: Subject to any disclaimer, the term of this patent is extended or adjusted under 35 U.S.C. 154(b) by 204 days.

This patent is subject to a terminal disclaimer.

(21) Appl. No.: 16/700,545

(22) Filed: Dec. 2, 2019

(65) Prior Publication Data

US 2020/0102711 A1 Apr. 2, 2020

Related U.S. Application Data

(63) Continuation-in-part of application No. 15/560,761, filed as application No. PCT/IB2016/051128 on Mar. 1, 2016, now Pat. No. 10,492,655.

(30) Foreign Application Priority Data

Apr. 16, 2015 (IT) ..... PN2015A000007

(51) Int. Cl.

| | |
|---|---|
| ***E01H 1/04*** | (2006.01) |
| ***A47L 11/24*** | (2006.01) |
| ***A47L 11/16*** | (2006.01) |

(52) U.S. Cl.

CPC ..... *E01H 1/045* (2013.01); *A47L 11/16* (2013.01); *A47L 11/24* (2013.01)

(58) Field of Classification Search

CPC ..... E01H 1/045; A47L 11/24; A47L 11/16; A47L 11/4058

See application file for complete search history.

(56) References Cited

U.S. PATENT DOCUMENTS

| | | |
|---|---|---|
| 2,631,314 A | 3/1953 | Fitzpatrick |
| 3,584,325 A | 6/1971 | Larsen |

(Continued)

FOREIGN PATENT DOCUMENTS

| | | |
|---|---|---|
| DE | 103 25 187 A1 | 1/2004 |
| EP | 0 843 046 A1 | 5/1998 |
| GB | 983503 A | 2/1965 |

OTHER PUBLICATIONS

Jul. 11, 2016 International Search Report issued in International Patent Application No. PCT/IB2016/051128.

(Continued)

*Primary Examiner* — Weilun Lo

(74) *Attorney, Agent, or Firm* — Oliff PLC

(57) ABSTRACT

A method for collecting garbage from a surface includes providing a motor-sweeper including a sweep broom. A rear guide is provided between the sweep broom and the collecting container extending downwards from the collecting container close to the sweep broom. The sweep broom rests with the guide assembly onto the surface, and the sweep broom is rotated in order to collect and convey the garbage into the collecting container. The rotation of the sweep broom causes the garbage to be swept forwardly and upwardly with respect to the forward motion of the motor-sweeper. In response to the bristles of the sweep broom wearing, the sweep broom is moved toward the surface and the guide assembly and the rear guide are moved towards the sweep broom so as to maintain uniform spaces between the sweep broom and the guide assembly, and the sweep broom and the rear guide.

13 Claims, 8 Drawing Sheets

(56) References Cited

U.S. PATENT DOCUMENTS

| | | | | |
|---|---|---|---|---|
| 3,930,277 | A | 1/1976 | Wulff | |
| 4,219,901 | A | 9/1980 | Burgoon et al. | |
| 6,687,939 | B1 | 2/2004 | Koester | |
| 2003/0182748 | A1 | 10/2003 | Watts | |
| 2004/0045585 | A1 | 3/2004 | Wilmo et al. | |
| 2004/0237231 | A1* | 12/2004 | Scita | E01H 1/0854 15/52.1 |
| 2010/0291843 | A1 | 11/2010 | Strickland | |
| 2013/0025076 | A1* | 1/2013 | Schick | B01D 46/10 15/21.1 |
| 2016/0256025 | A1* | 9/2016 | Van Der Kooi | A47L 11/24 |

OTHER PUBLICATIONS

Jul. 11, 2016 Written Opinion issued in International Patent Application No. PCT/IB2016/051128.

* cited by examiner

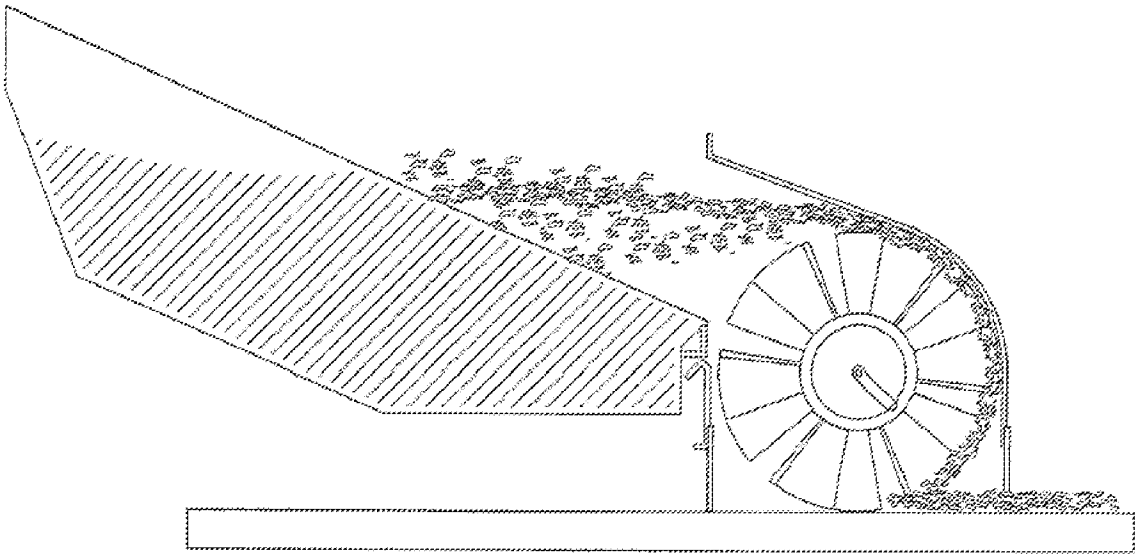
FIG. 5A
[PRIOR ART]
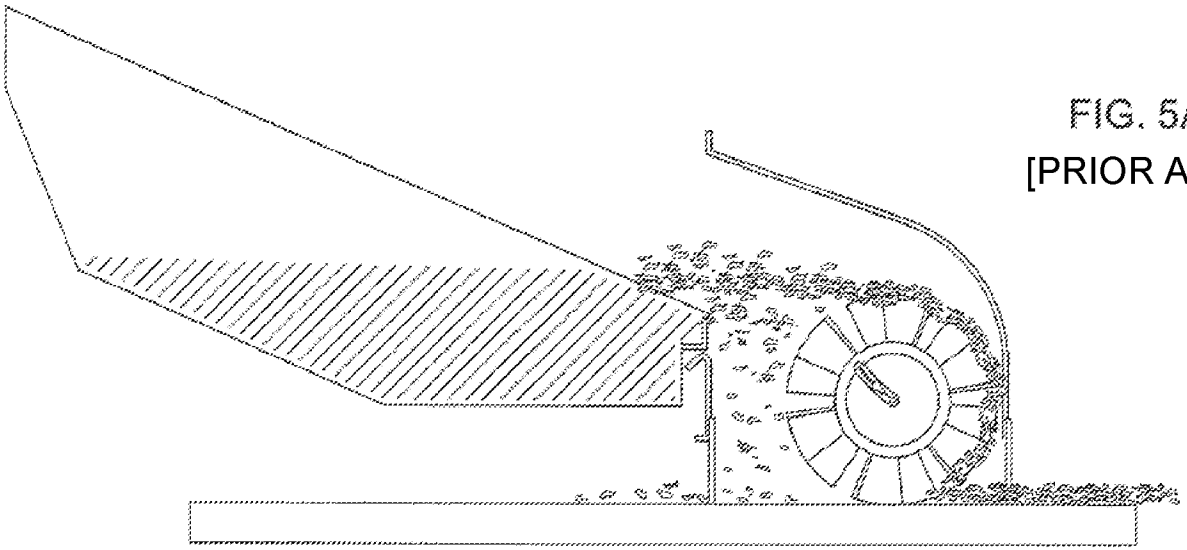

APPARATUS FOR COLLECTING GARBAGE AND DEBRIS FOR A MOTOR-SWEEPER

CROSS-REFERENCE TO RELATED APPLICATION

This application is a continuation-in-part application of U.S. application Ser. No. 15/560,761, filed on Sep. 22, 2017, which is a national stage application of International Application No. PCT/IB2016/051128, filed on Mar. 1, 2016, which claims priority from Italian Application No. PN2015A000007, filed on Apr. 16, 2015. The disclosure of the foregoing application is hereby incorporated by reference in its entirety.

TECHNICAL FIELD

The present embodiments to a motor-sweeper for cleaning large surfaces such as streets or industrial facilities.

In particular, it relates to an apparatus for collecting garbage and debris from a surface applied to a motor-sweeper.

BACKGROUND

In the field of motor-sweepers, it has long been known various structures that provide the possibility of regulating the position of the rotating brooms so that the distance between the surface being cleaned and their bristles is kept uniform despite their wear.

It is, in fact, known that the continuous friction with hard and rough surfaces involves the shortening of the bristles of the rotating brooms and consequently the pressure, with which the surface being cleaned is swept, is reduced.

In order to solve this drawback, the U.S. Pat. No. 4,219,901 describes a motor-sweeper provided with an articulated device or apparatus that allows the operator to adjust the distance from the ground for a cylindrical broom mounted below and transversally with respect to the longitudinal axis of the same motor-sweeper.

The apparatus is provided with an articulated arm comprising a cylindrical body and a rod. An adjusting knob is on the base of the cylindrical body protruding from the motor-sweeper in the operator direction. On the opposite base, the one that stays inside the body of the motor-sweeper, a first threaded end of said rod engages, whereas on a second end there is fixed a C-shaped support adapted to support said cylindrical broom.

On the body of the rod there are fixed arms apt at modifying the attitude of the articulated arm between a resting position wherein the broom is lifted from the ground, and operating positions wherein the broom touches the ground with various pressures.

Instead, the adjusting knob allows to modify the overall length of the articulated arm.

The operator can manipulate said knob in order to apply a rotation to the cylindrical body of the articulated arm into a first direction, so that the first threaded end of the rod screws itself in the cylindrical body, or in the direction opposed to the first one, so that the first threaded end of the rod exits from the cylindrical body. Consequently, the distance from the ground of the axis of the cylindrical broom is increased, such as in the case of a new broom, or reduced as the bristles wear more and more, so as to always obtain the required pressure for a proper cleaning of the ground.

The motor-sweeper further comprises an exhaust blower that generates an air flow that helps in conveying the dust portion of the debris into a collecting container.

Also patent application US 2010/291843 describes a motor-sweeper provided with devices to adjust the distance from the ground of rotating brooms. In particular the described motor-sweeper is provided with two groups of brooms, one mounted at the front and one located centrally under the motor-sweeper. The second group comprises a cylindrical broom mounted transversally with respect to the longitudinal axis of the motor-sweeper and designated for collecting and conveying the dirt into a container located at the rear of the motor-sweeper. The distance from the ground of said cylindrical broom can be adjusted by the operator by means of a knob that makes the support of said broom swing about an axis so as to make it keep a proper contact with the surface being cleaned. It is to note that the pivot whereon the support axis of the broom swings, is located before the same broom, with respect to the forward direction of the motor-sweeper, so as to move the broom at the same time downward and forward. This movement makes it possible to keep constant the distance with a front flap for retaining and collecting the dirt collected by the broom. In fact, in order to ensure an efficient collection it is necessary not only that the broom is properly in contact with the ground but also that there is not too much space between the same broom and the front flap otherwise its rotation could not ensure the necessary push of the dirt at the rear toward the container.

Such devices only partially solve the problem of keeping constant the capability of collecting debris and garbage from the surface being cleaned due to the wear of the brooms.

In fact, with reference to the motor-sweeper described in the above-mentioned second prior art document, the conveying apparatus is certainly capable of adjusting the position of the transverse broom so that it remains in contact with the surface being cleaned and near the surface of the chamber wherein it is housed so as to convey debris and garbage upward, but in doing so it distances said rotating broom from the collecting container (FIG. 5A). Such progressive distancing of the rotating broom from the collecting container, necessary to balance the wear of the brooms and accordingly to fill the gap between the bristles or front flap, causes part of the garbage and debris to fall back down on the ground behind the broom forcing the operator to pass again on the areas already treated resulting in a waste of time, increase in the means wear, beside involving a lesser filling of the collecting container that therefore requires more stops to discharge the collected garbage and debris.

A similar motor-sweeper is also described in European patent application EP 0843046, wherein it is described a machine for cleaning the floor comprising a cylindrical rotating broom mounted on a rotation axis or hub whose ends are supported by an articulated intermediate frame in a position on the support frame of the same motor-sweeper (see column 4, lines 24-30). The position or the articulation axis enables the intermediate frame to adjust the position of the rotating broom with respect to the ground as a consequence of its wear (see column 4, lines 53-54 and column 6, lines 53-56). Moreover a leverage system allows a front flap to be adjusted so as to follow the broom adjustment downward at the front in order to keep there a continuous controlled distance.

Now, with reference to FIGS. 1, 2 and 4 it can be clearly seen that the articulation point which allows the above-said lowering movement of the intermediate frame to the ground, only involves the lowering of the broom toward the ground, therefore making up for the wear of the broom with respect to the ground and at the front, but not at the rear where the garbage collecting container is located.

SUMMARY

The technical problem at the core of the embodiments is therefore that of providing an apparatus capable of solving the performance deterioration of the garbage and debris collection in a simple and inventive way. In particular, the embodiments described hereinafter allow to greatly reduce, if not eliminate, the part of garbage and debris that falls back on the ground during the first pass of a motor-sweeper.

Such problem is solved by an apparatus that adjusts both the position of the rotating broom and that of a conveyor so that, on the one hand, the distance between a peripheral surface of said broom and the surface being cleaned basically remains the same and on the other hand, that the distance between the broom and the conveyor and between the broom and the container does not increase considerably due to the progressive wear of the broom, so as to achieve that the capability of removing the debris is constant.

The apparatus object of the embodiments is normally applied to a rear load machine. Garbage and debris are lifted by the broom which rotates in the opposite direction with respect to the forward direction and, by means of a curved surface, or conveyor they are conveyed toward the collecting container.

BRIEF DESCRIPTION OF FIGURES

Further characteristics and advantages of the apparatus for collecting garbage and debris having an adjustable conveyor for a motor-sweeper object will become more apparent from the following description of an embodiment, for exemplification only but not limited to, with reference to the following figures, wherein:

FIGS. 5A and 5B are schematic views that compare the operating way of an apparatus of the prior art with an apparatus according to an embodiment.

DETAILED DESCRIPTION

The idea the embodiments are based on is that of providing an apparatus capable of carrying out two adjustments so as to keep uniform the sweeping action quality carried out by a motor-sweeper that is, the adjustment of the distance of a transverse sweep broom from the surface and the adjustment of the conveyor shape that is, the distance between the sweep broom and the conveyor and between the sweep broom and the container is kept uniform.

After a great number of experimental tests it has been developed an apparatus which allows the conveyor to modify its arrangement or shape, in order to keep uniform the optimal distance between its free edge and the sweep broom. In other words, the space between the conveyor and the sweep broom in correspondence of the surface has to be uniform. To this purpose, the conveyor has to move along with the rotating sweep broom movement realized by suitable means in response to the progressive reduction of its diameter because of wear. At the same time, the space between the sweep broom and the rear container must be kept uniform.

Thanks to this apparatus it has been proved that, even with a worn sweep broom, it is possible to both avoid worsening the performance of the debris and garbage collection, and exploit effectively the capacity of a collecting container.

Figure 1:
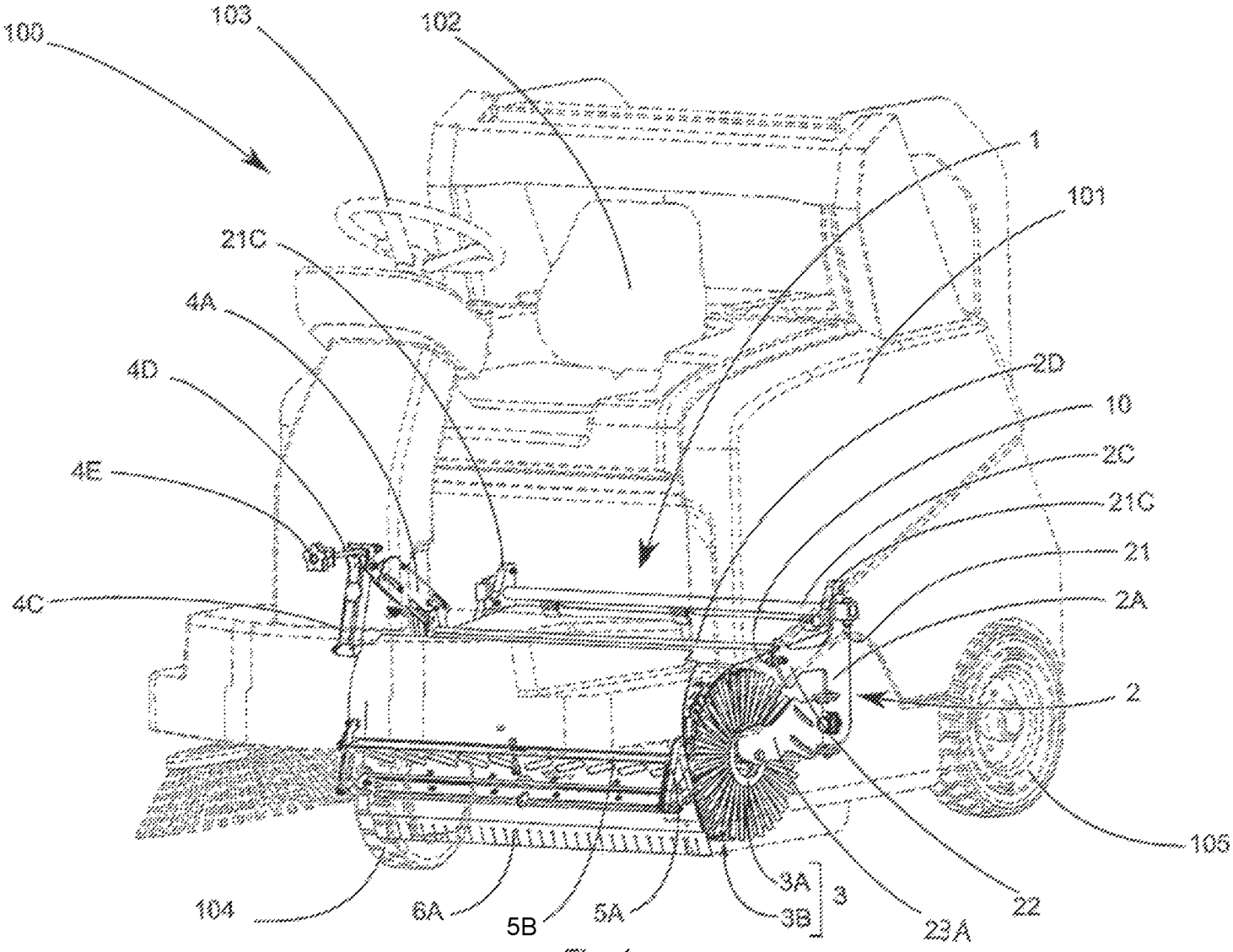
FIG. 1 is an overall perspective view of an embodiment of the apparatus for collecting garbage and debris having the moveable conveyor object, installed on a motor-sweeper.

With reference to FIG. 1, a motor-sweeper 100 comprises a body 101 whereon it is installed a seat 102 for the operator, a steering wheel 103 attached by means of mechanisms (not shown) to a steering and driving wheel 104 in order to steer its movement and provide motion to the motor-sweeper 100. At the opposed end of the body 101 with respect to the wheel 104, there are support wheels 105, only one of which can be seen in FIG. 1.

It is to note that in the present description the terms front and rear, upper and lower and the like are used to show the relative position of any element or device of the motor-sweeper with respect to the front, rear, upper, lower part of the same motor-sweeper in the usual working conditions, that is moving forward on a surface being cleaned.

In the lower part of the body 101, in a position included between the front wheel 104 and the rear wheels 105, there is installed an apparatus 1 for collecting debris and garbage and for conveying them toward a compartment or container 11 to collect said garbage and debris collected from the surface being cleaned.

In particular, the apparatus 1 comprises a sweep broom support 2 adapted to correctly position, with respect to the surface, a sweep broom 3 having a rotating axis X-X substantially parallel to a surface G being cleaned, a leverage assembly 4 apt to adjust the pressure of said sweep broom 3 on the surface, a device 5, 7 (FIGS. 2, 3 and 4B) to adjust a conveyor 6 having a curved surface (FIGS. 2, 3, and 4), the conveyor being apt to guide garbage and debris collected by said transverse sweep broom 3 toward said collecting container 11 (FIGS. 2 and 3).

Figure 2A:
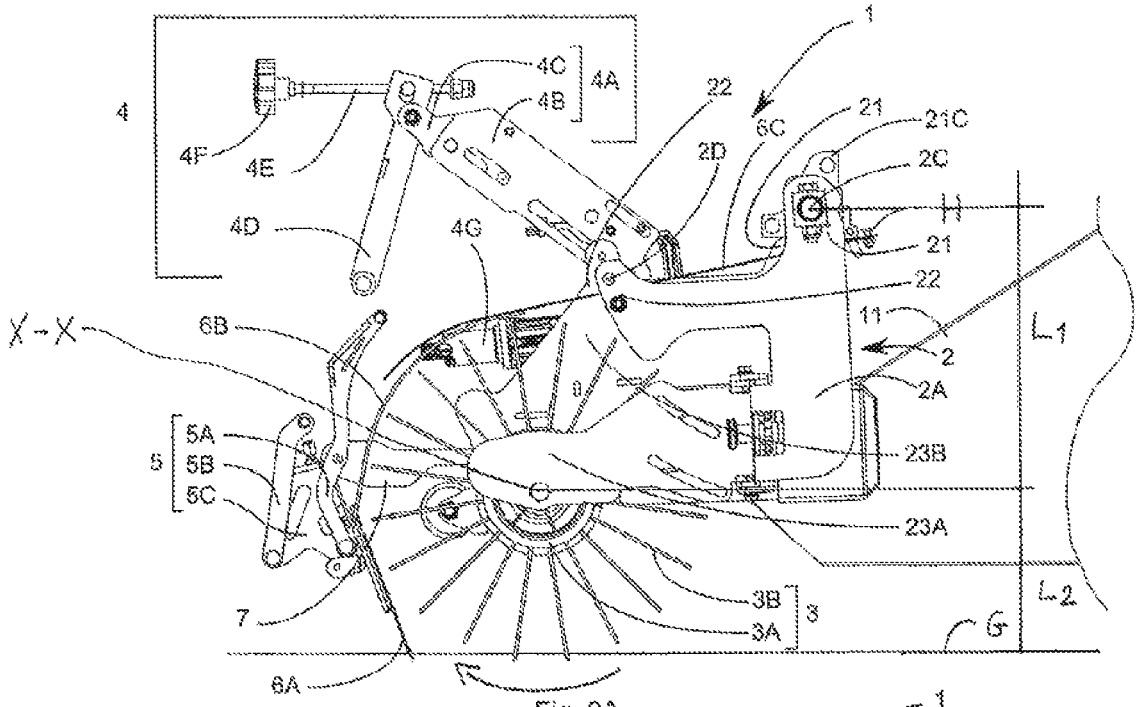
FIGS. 2A and 2B are views from a first side of the apparatus of FIG. 1, wherein the apparatus is shown in two conditions depicting a different wear of the broom.
Figure 3A:
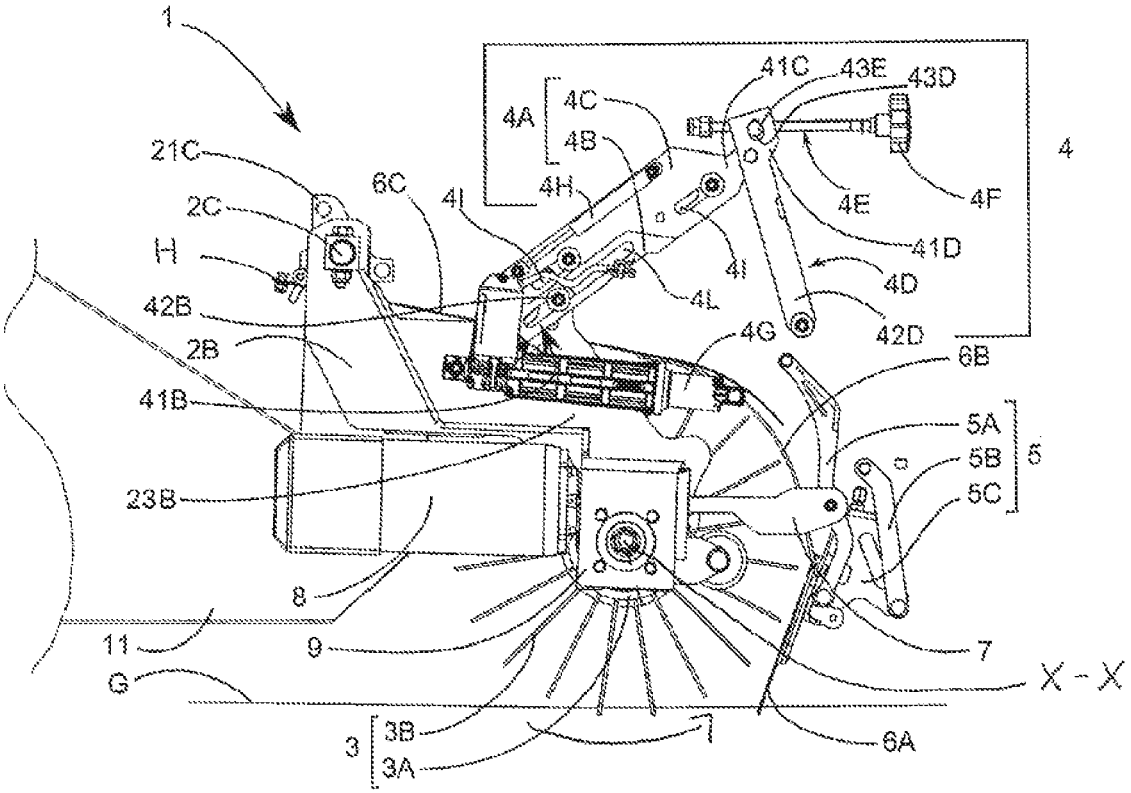
FIGS. 3A and 3B are views from a second side of the apparatus of FIG. 1, wherein the apparatus is shown in two conditions depicting a different wear of the broom.

The sweep broom support 2, in the embodiment shown for exemplification in FIGS. 2A and 3A, comprises two sides, a first one 2A and a second one 2B, parallel and vertical with respect to the surface. The first side 2A and the second side 2B are formed by metal plates rigidly joined one to the other by means of a first and a second bar 2C, 2D, parallel each other and parallel to said surface G. Each first and second side 2A, 2B is shaped so as to provide a first portion 21 and a second portion 22 whereon the ends of said first and second bar 2C, 2D engage respectively. In particular, the axis of said first bar 2C coincides with the rotating axis about which said sweep broom support 2 rotates so as to allow the regulation of the brooms on the surface or, as it will be described later, to keep the correct adherence of the brooms to the surface even when its bristles are worn.

It is to note that said first bar 2C and the respective first portion 21 of the first side 2A and of the second side 2B, is mounted at the rear with respect to the forward motion of motor-sweeper 100, while the second bar 2D, and the respective second portion 22 of the first side 2A and of the second side 2B, is mounted at the front with respect to the motor-sweeper 100. Furthermore, the first bar 2C is rotatably mounted on the frame (not shown) of the motor-sweeper body 101 through two suitable supports 21C each one placed in correspondence of each end of the same bar.

Figure 2B:
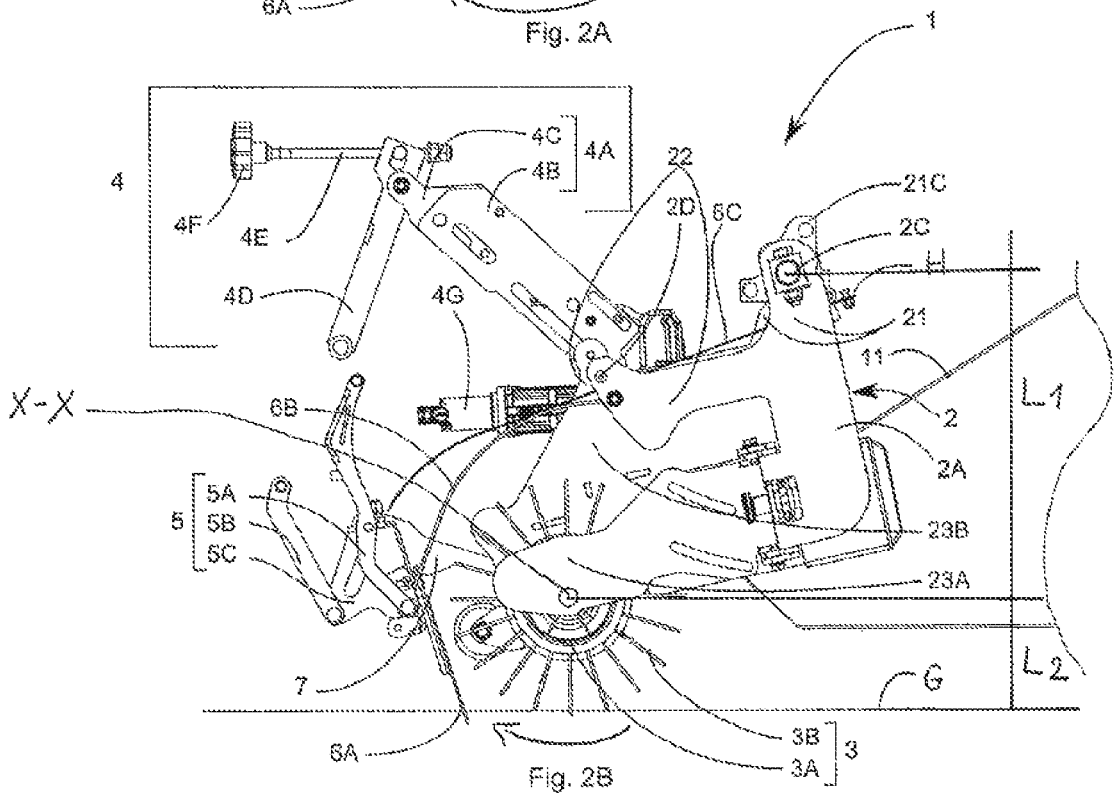

Advantageously, moreover, the first side 2A and the second side 2B are mounted on the first bar 2C at a height $L_1$ from the surface G higher than the height $L_2$ from the surface G of the rotating axis X-X of the broom 3 (FIGS. 2A and 2B). In other words, the rotating axis or swinging of the broom support 2 is positioned at a height $L_1$ from the surface G higher than the height $L_2$ from the surface G of the rotation axis of the sweep broom 3 and, at the same time, at a position rearmost with respect to the rotating axis of the sweep broom 3, with reference to the forward motion of the motor-sweeper 100 or, in other words, with reference to the front part of the same motor-sweeper.

The first side 2A and the second side 2B also comprise third portions 23A and 23B respectively that extend lower with respect to said first portion 21 and second portion 22 of the first side 2A and second side 2B. The third portions 23A and 23B, preferably protrude frontward with respect to said second portions 22 so as to define two support arms between which the sweep broom 3 is rotatably mounted. In particular, the third portion 23A of the first side 2A is preferably hinged to the respective first and second portions 21, 22 so as to be able to rotate and allow the installation and removal of the sweep broom 3. The third portion 23B of the second side 2B is, on the contrary, designed to support an electric motor 8 and preferably a gearmotor 9 that causes said transverse sweep broom 3 to rotate.

The transverse sweep broom 3 is made according to the known art, and comprises a cylindrical body 3A from the side surface of which bristles 3B, suitably spaced one from the other, protrude. The bases of said cylindrical body 3A engage on suitable supports (not shown) fixed on the first side 2A and on the second side 2B. In particular, the support mounted on the second side 2B is realized so as to engage, directly or by means of other known mechanisms, with a shaft of said gearmotor 9. It is to note, as shown in FIGS. 2A and 2B, that the rotating axis X-X of the sweep broom 3 is substantially parallel with respect to the surface being cleaned G and preferably transverse with respect to the motion direction of the motor-sweeper 100 or, in other words, transverse with respect to the longitudinal axis of the same motor-sweeper. Furthermore, as already said, the rotating axis X-X is at a height $L_2$ from the surface being cleaned G lower than the height $L_1$ from the surface being cleaned G of the rotating axis or swinging of the broom support 2, as already said the latter axis coinciding with the above-mentioned first bar 2C.

The pressure with which the transverse sweep broom 3 acts on the surface is adjusted by the leverage 4. In the preferred embodiment shown in FIGS. 2-4, said leverage 4 comprises a first arm 4A composed of a first element 4B and of a second element 4C, a second arm 4D, a regulating rod 4E, an actuator 4G adapted to move the apparatus 1, by means of said arms, between a lowered operating position wherein the transverse sweep broom 3 is in contact with the surface being cleaned, and a resting position wherein the transverse sweep broom 3 is distanced from the surface being cleaned when it is necessary to move in order to reach the working areas. In particular, the leverage 4 is positioned higher than the broom support 2.

Each of the two elements, first 4B and second 4C of the first arm 4A comprises one or more first slots 4I (FIGS. 3A and 3B) crossed by corresponding joining means such as bolts (not numbered in the drawings), or other devices suitable to the purpose, that allow said elements 4B and 4C to slide one with respect to the other so as to adjust the overall length of the first articulated arm 4A at the different positions the broom support 2 has to acquire. Preferably, these two elements are made of two flat plates that slide one with respect to the other along their longitudinal axis. Furthermore, a second slot 4L extends longitudinally from a first end 41B of the first element 4B.

The first end 41B of the first element 4B is, further, joined to said second side 2B by means of a respective bolt 42B which engages said second slot 4L so as to allow the mutual sliding of the first arm 4A and of the broom support 2. A first end 41C of the second element 4C, opposite to the first end 41D of the first element 4B, is rotatably connected to said second arm 4D thus forming a compass structure.

Figure 3B:
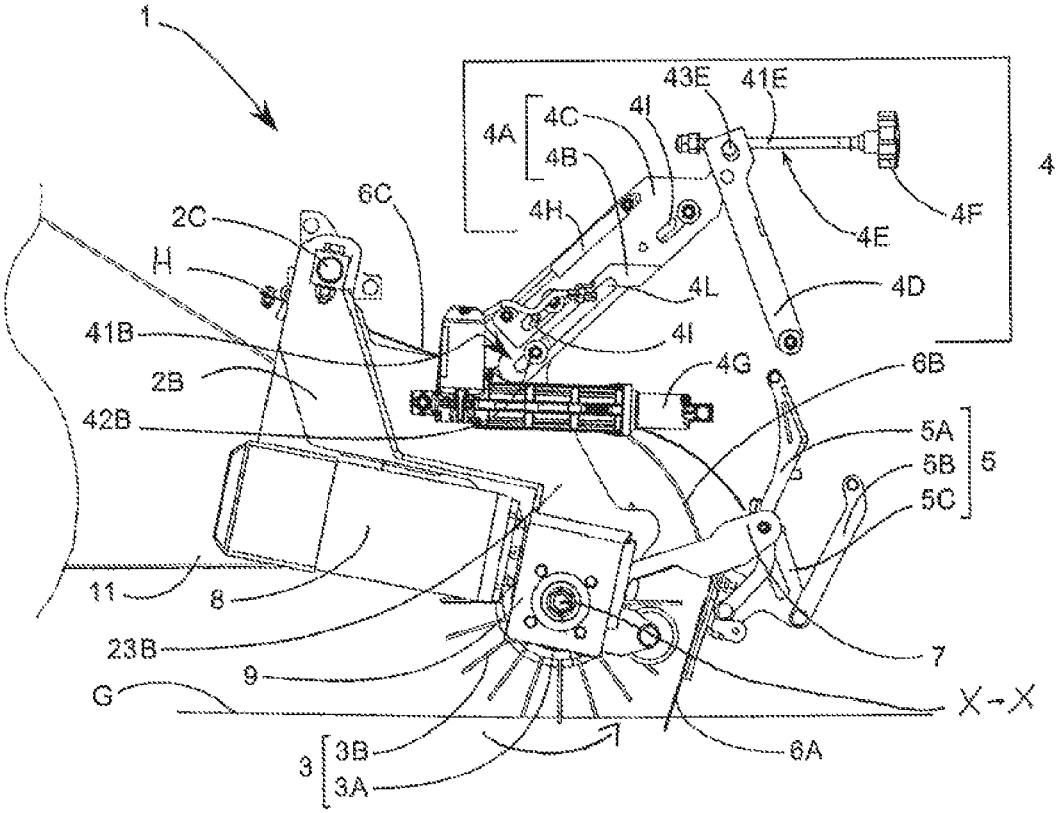

A damper 4H, for example a gas spring shown in FIGS. 3A and 3B, is mounted on said two elements 4B and 4C of said first arm 4A by means of respective slots and bolts (not numbered in the drawings) so as to allow the mutual and dampened sliding of the same elements in order to absorb the bumps the apparatus might receive on a harsh ground, or when the motor-sweeper 100 meets too big objects on its path.

The second arm 4D comprises a first end 41D connected to the first end 41B of the first element 4B of the first arm 4A and a second end 42D joined with suitable means to the body 101 of the motor-sweeper 100. In addition, said first end 41D preferably further comprises a slot 43D for engaging the rod 4E.

The rod 4E comprises a longitudinal stem portion 41E and an end knob 4F. The rod 4E is slidably fastened to a frame portion (not shown) of the motor-sweeper in the traditional way. The stem portion 41E engages said second arm 4D pulling or pushing it along the direction of the axis of the same stem. Preferably, the stem portion 41E is provided with a transverse pin 43E engaging the slot 43D of the second arm 4D. Therefore, in this configuration, by rotating the knob 4F integral to the rod 4E it is possible to change the incline of the second arm 4D that, consequently changes the incline of the articulated arm 4A and in cascade it changes the incline of the broom support 2 causing it to rotate pivoted on the first bar 2C. Hence, the distance of the sweep broom 3 from the surface is in turn changed.

In particular, the above said manipulation of the broom support 2 and of the respective sweep broom 3 for changing the distance of the broom from the surface, and consequently its pressure on the same surface in order to achieve an efficient cleaning, is commanded by the operator of the motor-sweeper 100 in the following way. By rotating the knob 4F, the second arm 4D moves its first end 41D away from the same knob (FIGS. 2B and 3B), pivoting with its second end 42D which is rotatably joined to the frame of the motor-sweeper 100. This movement causes a downward thrust of the first arm 4A, as the first end 41D of the second arm 4D is joined to the first end 41C of the second element of the first arm 4A. Since the first arm 4A is connected with its first end 41B to the second portion 22 of the second side 2B of the broom support 2, the downward thrust of the first arm 4A further causes the downward movement of the second portion 22 of the broom support. Consequently, also the third portion 23B of said broom support whereon the sweep broom 3 is mounted, moves downward, thanks to the fulcrum formed on the first bar 2C whereon the first portion 21 of the second side 2B pivots. Advantageously, moreover, the movement of the broom support 2 further comprises a combined movement toward the rear of the motor-sweeper 100, that is toward the garbage container 11. Practically, the movement of the broom support 2 is a lever-like complex movement resulting in the power transmitted by the leverage 4 to the second portion 22 of the first and of the second sides 2A, 2B, fulcrum on the first bar 2C and resistance on the bristle 3B of the sweep broom 3 resting on the surface. It results that the resulting movement is an arc of a circle (or oblique line with respect to the vertical on the surface G) extending from the top to the bottom and from the front to the rear of the motor-sweeper. It is to note, therefore, that the rotating fulcrum of the broom support 2 is positioned in correspondence of the first bar 2C which is at the rear and higher than the rotating axis of the sweep broom 3, as previously described.

Advantageously, according to the an embodiment, the rotation of the broom support 2 is transmitted by means of said device 5, 7 to the guide assembly 6. In fact, the device comprises a bracket 7 fixed with a first end to the third portion 23B of the second side 2B of the broom support 2 and with a second end to a pantograph structure 5.

Figure 4A:
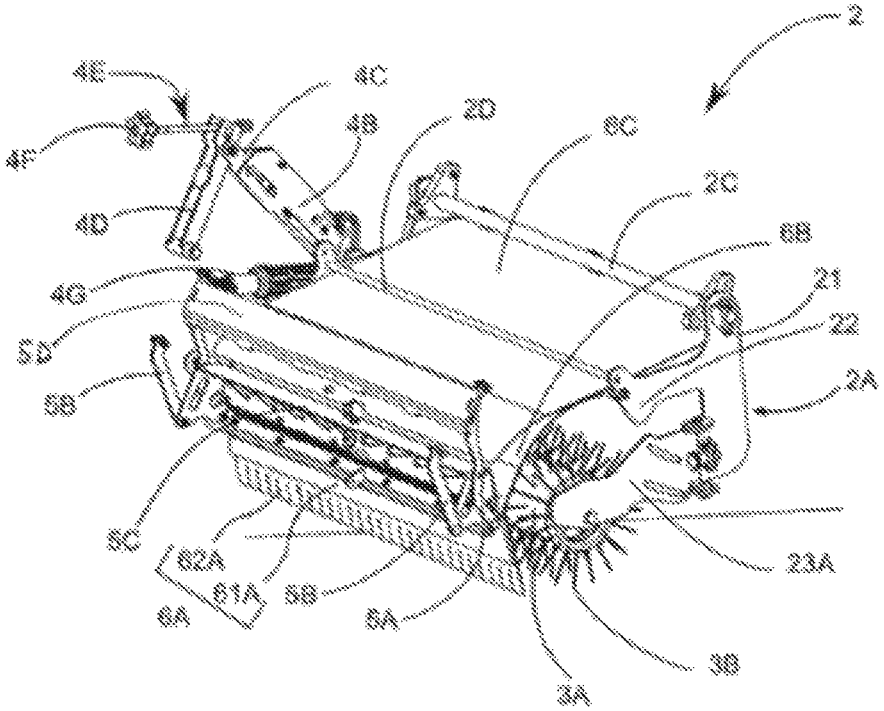
FIGS. 4A and 4B are perspective views respectively from the first side and from the second side of the apparatus of FIG. 1.
Figure 4B:
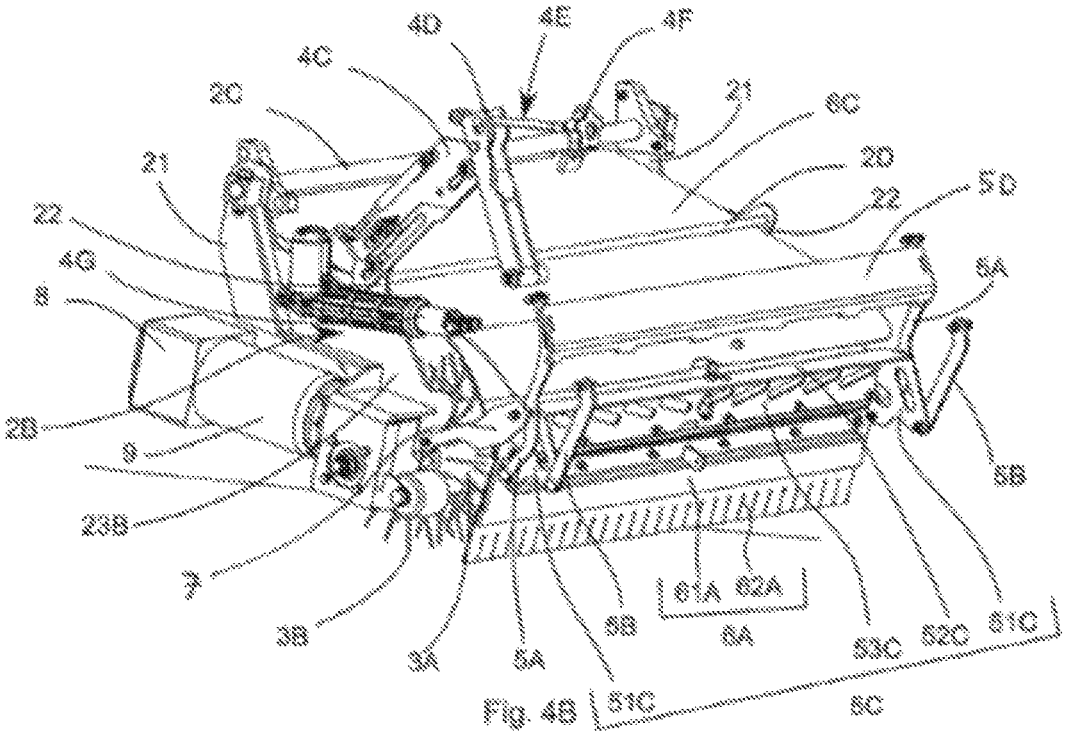

In particular, the pantograph 5 is preferably positioned before the sweep broom 3 with respect to the forward motion of the motor-sweeper 100 and comprises two pairs of parallel first and second arms 5A, 5B. These pairs of arms are each placed substantially in-line with a respective first side 2A and second side 2B of the broom support 2. Furthermore, they are oriented so as to have upper ends of each first arm 5A and second arm 5B bound to the body 101 of the motor-sweeper 100, and lower ends linked by a connecting element 5C formed by two sides 51C connected each other by a beam 52C. Preferably, the beam 52C is, in its turn, formed by a bar having an inverted L-shape section with a first portion 53C generally plate-like provided with one face facing the broom and one facing the opposite direction (not numbered in the drawings), both faces being slightly inclined with respect to the perpendicular to the surface G (FIG. 4B). Preferably, a bar 5D extends between the upper ends of the first arms 5A in order to make the pantograph structure 5 rigid against possible strains tending to misalign the same arms one from the other (FIGS. 4A and 4B).

The guide assembly 6 or guide of the debris and garbage of the collecting apparatus 1 of an embodiment advantageously comprises an assembly including a flap 6A, a connecting portion 6B and a guiding portion 6C to guide the debris uplifted by the sweep broom 3 toward the container 11.

In particular, the flap 6A (FIGS. 4A and 4B) is bound to the pantograph 5 so as to follow its movements. The bind occurs by means of elements binding said flap preferably to the first portion 53C of the beam 52C of the pantograph 5. Preferably, the flap 6A comprises a support 61A, fixed to said first portion 53C, from whose lower side an elastic blade 62A, of the traditional type, protrudes which is adapted to scrape the surface and to be a check for the sweep broom 3 during its operation. Alternatively, said flap may be formed by one piece only.

A connecting portion 6B (FIGS. 2 and 3) is formed by an elastic curved plate having a concavity facing the sweep broom 3 and that, preferably follows its motion for about a quarter of a turn. That portion, as well, is joined to the pantograph 5 at one side, for example to the first portion 53C of the beam 52C, and on the contrary it is free at the other side.

The guiding portion 6C (FIGS. 2 and 3) is formed by a plate extending over the sweep broom 3 so as to cover the whole extension of the broom support 2 as well. In particular, the portion 6C is fastened to the frame of the motor-sweeper 100 at the rear and rotatably to the broom support 2, for example by means of hinges H, and passes below the first bar 2C and the second bar 2D of the broom support 2 lying on support elements 10 (only one shown in FIG. 1) fixed to the inner wall of each of said first side 2A and second side 2B of the same broom support 2. The front end of the portion 6C is then arched so as to follow the roundness of the sweep broom 3 and so as to overlap at least part of the connecting portion 6B of the guide assembly 6. In other words, the guiding portion 6C is "sandwich" kept between the first and the second bars 2C, 2D on the upper part and the supports 10 on the lower part so as to rotate solidly with the broom support 2 thanks to the hinge H.

In its movement, the pantograph structure 5 changes the position of the flap 6A fixed on said element 5C, so that said flap 6A remains close to the peripheral surface of said transverse sweep broom 3. In the same way and at the same time, the movement of the broom support 2 commanded by the leverage 4 also commands the guiding portion 6C of the guide assembly 6.

In other words, as shown in FIGS. 2B and 3B, when the sweep broom 3 is worn out, the operator manipulates the knob F of the leverage 4 so as to lower the broom support 2, as previously described. This movement, thanks to the connecting bracket 7 between the broom support 2 and the pantograph structure 5, pulls the two pairs of arms 5A and 5B so as to bring the flap 6A close to the sweep broom 3. At the same time, the connecting portion 6B of the guide assembly 6 is pushed toward the rear of the motor-sweeper 100, that is toward the first portions 21 of the first and second sides 2A, 2B of the broom support 2. Thus, the connecting portion 6B slides underneath the guiding portion 6C of the guide assembly. Thanks to the elasticity of these two portions there is not any discontinuity in the whole inner surface of the guide assembly. In other words, the flap 6A is joined to said broom support 2 by means of a device comprising said pantograph 5 and said bracket 7 in order to command, in a coordinate way, the movement of the guide assembly 6 with the movement of the rotating sweep broom 3 commanded by said leverage 4.

As it can be seen comparing FIGS. 2A and 2B and FIGS. 3A and 3B, the overall shape of the moveable guide assembly 6 adjusts itself so as to remain close to the ends of the bristles 3B of said transverse sweep broom 3 at least in the front portion of the same broom. Thus garbage and debris caught by the bristles 3B, are guided toward said collecting container 11.

Figure 5B:
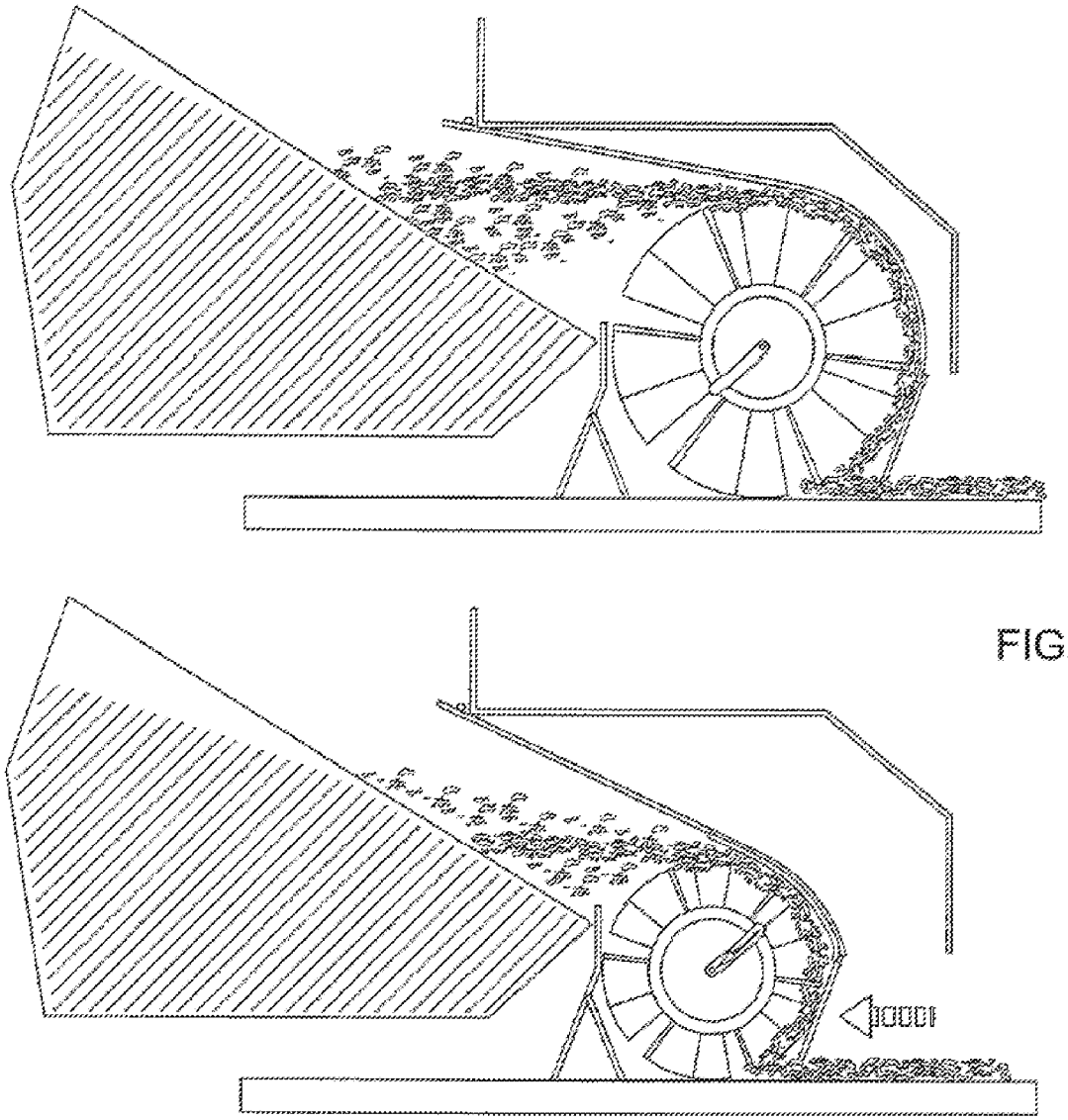

Differently from what occurs in the motor-sweepers of the known art, wherein the movement of the sweep broom takes place downward and in a direction that distances the broom from the container (FIG. 5A), the transverse sweep broom 3 in the apparatus 1 according to an embodiment makes a movement downward and rearward (FIG. 5B), followed in its movement by the curved surface 6, so as to keep uniform the distance from the collecting container. This implies that all the garbage and debris uplifted by the broom of the apparatus 1 according to the embodiment reach the collecting container. In fact, such garbage and debris are pushed in succession against the flap 6A, the connecting portion 6B and the guiding one, from the front upwardly and toward the rear of the motor-sweeper 100 thanks to the rotation of the same broom which, in fact, lifts and pushes the garbage forwardly and upwardly with respect to the forward motion. In the apparatuses according to the prior art, on the contrary, because of the increase of the broom-container distance, part of the debris fall back on the ground behind the broom making it necessary other passages of the motor-sweeper. In fact, as previously said, the movement of the broom takes place at the front with respect to the same broom so that the latter is lowered and moved forward toward the flap for the debris retaining, or it takes place with a movement axis positioned lower than the rotation axis of the broom but always only resulting in a lowering of the broom toward the surface. In this regard, it is to keep in mind that the broom support 2 can alternatively be positioned before the broom 3, as in the prior art, using systems of movement of the broom that allow its movement downward and toward the container 11 of the garbage collection. Such systems can be, for example, two lateral and telescopic arms each one at the ends of the broom and there connected so as to allow the rotation of the broom by means of, for example, bushings connected to the rotation shaft in neutral. On the contrary, the guide assembly 6 remains as previously described.

Finally, on the motor-sweeper 100 there is also mounted an exhaust blower (not shown) adapted to guide toward the filters (not shown) housed in the motor-sweeper body 101 the dusts generated and/or lifted by the scraping of the bristles 3B of the rotating sweep broom 3 against the surface being cleaned.

A further embodiment includes a motor-sweeper 100 comprising the apparatus 1 for collecting garbage previously described.

Still a further embodiment is a method for collecting garbage from a surface G comprising the steps of:

- providing a motor-sweeper 100 comprising a cylindrical rotating sweep broom 3 for conveying garbage in a collecting container 11 located behind the broom 3 with respect to the forward direction of the motor-sweeper 100 and a garbage guide assembly 6 covering said broom in order to be close to its front and extending to said container;
- resting said broom with said conveyor on to the surface G to be cleaned;
- operating said rotating broom 3 in order to collect and convey the garbage into the collecting container 11, the rotating versus of the broom causing the garbage to be swept forwardly and upwardly with respect to the forward motion of the motor-sweeper;
- moving said broom 3 toward the surface G and toward the garbage container 11 following the wearing of the bristles of the broom and so as to substantially maintain uniform the space between the broom and the collecting container, and at the same time
- moving said guide assembly 6 to follow the movement of said broom so as to substantially maintain uniform the space between the broom and the guide assembly.

Preferably, the last two steps of moving the broom and the guide assembly are carried out not only at the same time, but also through just one command.

Preferably, said method is realized with a motor-sweeper 100 provided with the apparatus previously described.

From the foregoing, it is apparent that all the drawbacks linked to the prior art previously described have been solved.

The new apparatus 1 having a moveable guide assembly 6 makes it possible to keep to a minimum the space between the rotating sweep broom 3, the same moveable guide assembly 6 and the collecting container 11, despite the progressive wear of said rotating broom 3, thanks to the combination of a mechanism regulating the broom position operatively connected to a regulating mechanism of the guide assembly of the debris collected by the broom. In fact, the mechanism regulating the position of the broom, that is the leverage 4 and the broom support 2, acts in a coordinate way with the mechanism regulating the guide assembly, in particular the pantograph 5 in order to keep uniform the distance between the guide assembly 6 and the broom 3 and between the broom and the garbage container 11. This makes it possible to ensure a constant capability of filling the collecting container even when the broom bristles are worn out. Furthermore, the command given by the sole knob advantageously allows to operate all the above said regulations in a coordinate way.

Figure 5C:
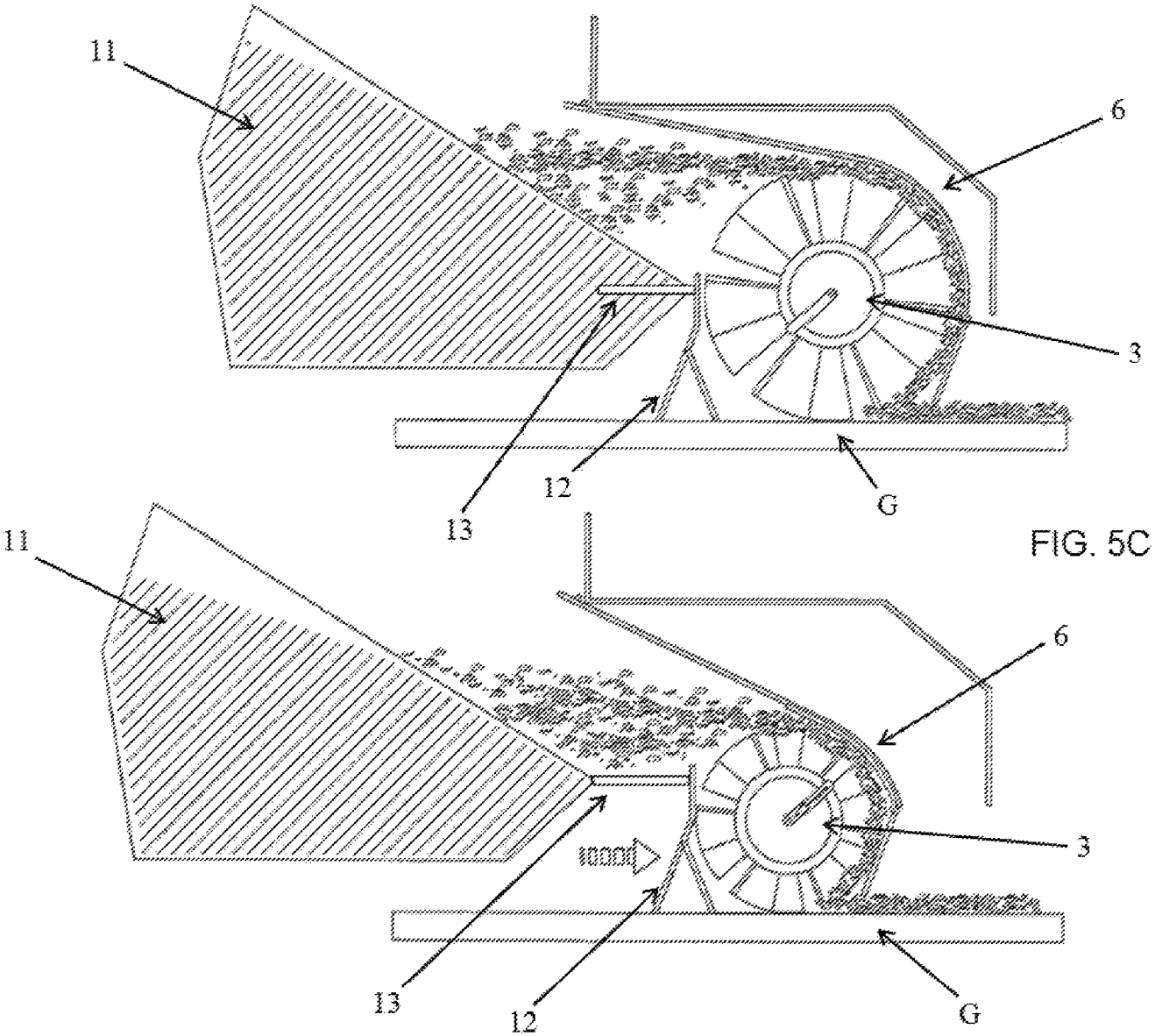
FIGS. 5C and 5D are schematic views illustrating the operating of an apparatus in accordance with alternate embodiments.

In a further embodiment, and with respect to FIG. 5C, the apparatus includes a sweep broom support 2 rotatably supported onto a first bar connected to a body of the motor-sweeper, as shown in FIG. 5C. A sweep broom 3 is mounted onto the sweep support such that the sweep broom 3 has a rotating axis parallel to a surface G to be cleaned. The apparatus further includes a collecting container 11 configured to collect garbage. The collecting container 11 is positioned behind the sweep broom 3 with respect to the forward direction of the motor-sweeper. A rear guide 12 is disposed between the sweep broom 3 and the collecting container 11 and extends from the collecting container 11 downwards to a region proximal to the sweep broom 3.

A leverage assembly 4 acts on the support to regulate the distance of the sweep broom 3 from the surface G. A motor is provided and is configured to activate the sweep broom 3. A guide assembly 6 is arranged to guide the debris uplifted by the broom 3 towards the collecting container 11. A rear guide assembly 13 in communication with the rear guide 12 is configured to regulate the distance of the rear guide 12 to the rotating sweep broom 3. In response to the bristles of the sweep broom 3 becoming worn, the leverage assembly 4 commands the sweep broom support 2 to move the rotating sweep broom 3 towards the surface G to be cleaned. The rear guide assembly 13 commands the rear guide 12 to move towards the rotating sweep broom 11. In addition, the guide assembly 6 follows the movement moving the rotating broom 3 so as to maintain a uniform space between the sweep broom 3 and the guide assembly 6, and to maintain a uniform space between the sweep broom 3 and the rear guide 12.

In another embodiment, in response to bristles of the sweep broom 3 becoming worn, the leverage assembly 4 commands the sweep broom support 2 to move the sweep broom 3 towards the surface G to be cleaned and towards the guide assembly 6 so as to maintain a uniform space between the sweep broom 3 and the guide assembly 6. In addition, the rear guide assembly 13 commands the rear guide 12 to move towards the guide assembly 6, so as to maintain a uniform space between the sweep broom 3 and the rear guide 12.

With respect to FIG. 5C, a method for collecting garbage from a surface G includes providing a motor-sweeper including (i) a sweep broom 3 for conveying garbage in a collecting container 11 located behind the sweep broom 3 with respect to the forward direction of the motor-sweeper, and (ii) a garbage guide assembly covering the sweep broom 3 in order to be proximal to its front and the guide assembly 6 extending to the collecting container 11. A rear guide 12 is provided between the sweep broom 3 and the collecting container 11 with the rear guide 12 extending downwards in a vertical direction from the collecting container 11 and proximal to the sweep broom 3. The rear guide 12 may extend inclined or angled with respect to the collecting container 11 so as to extend in a generally vertical direction. However, the rear guide 12 may have no vertical component. For example, the rear guide 12 could be an arc or have sloped segments with no vertical component. The sweep broom 3 is then rested with the guide assembly 6 onto the surface G. The sweep broom 3 is then rotated in order to collect and convey the garbage into the collecting container 11. The rotation of the sweep broom 3 causes the garbage to be swept forwardly and upwardly with respect to the forward motion of the motor-sweeper. In response to bristles of the sweep broom 3 wearing away, the sweep broom 3 is moved toward the surface G and the guide assembly 6 and rear guide 12 are moved towards the sweep broom 3 using a suitable linkage. The respective moving of the sweep broom 3, guide assembly 6, and rear guide 12 maintain a uniform space between the sweep broom 3 and the guide assembly 6, and maintain a uniform space between the sweep broom 3 and the rear guide 12.

In yet another embodiment, the method includes, in response to the bristles of the wearing, moving the sweep broom 3 toward the surface G and towards the guide assembly 6 so as to maintain a uniform space between the sweep broom 3 and the guide assembly 6, and moving the rear guide 12 towards the guide assembly 6 so as to maintain a uniform space between the sweep broom 3 and the rear guide 12.

Figure 5D:
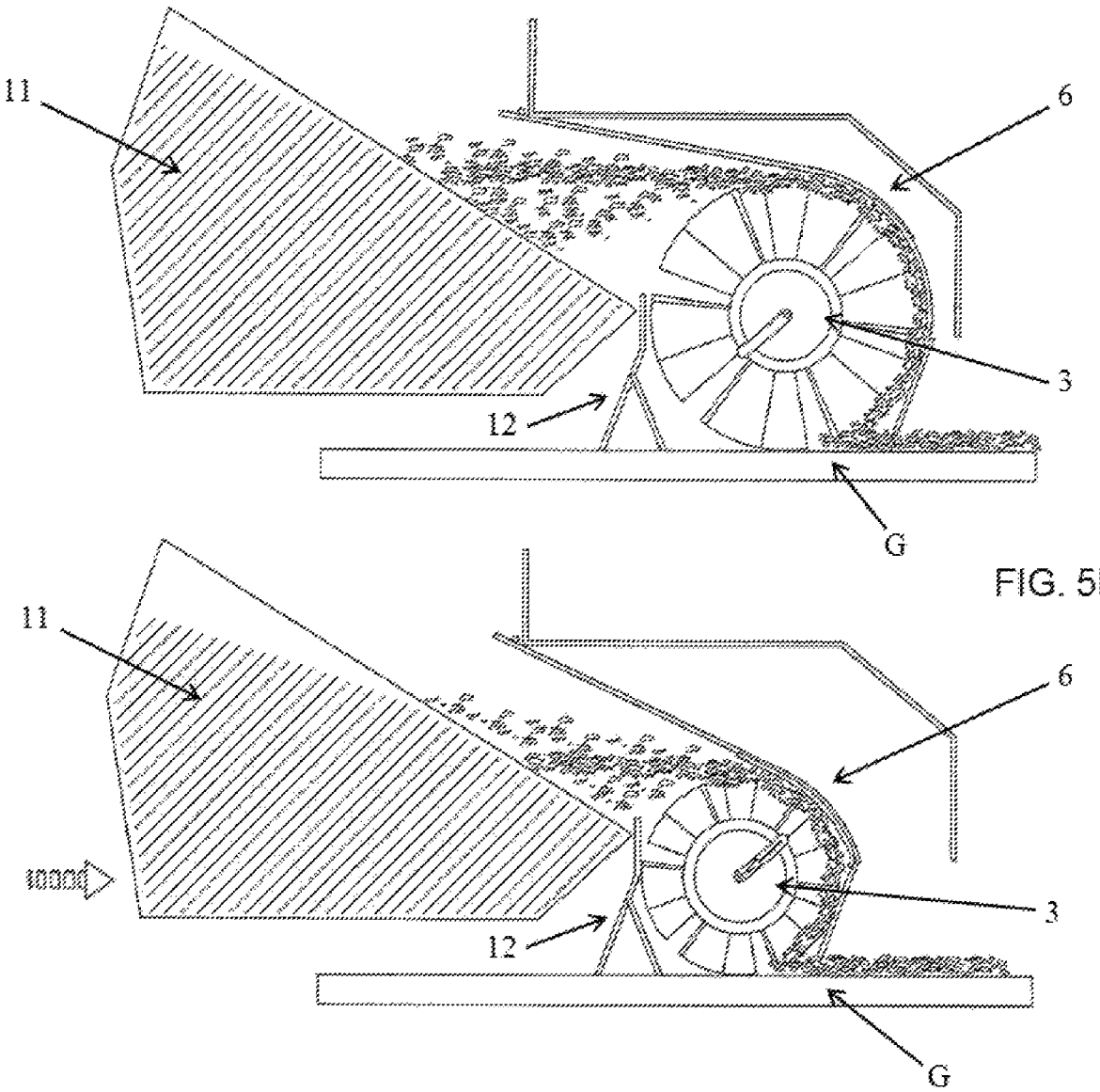

In yet another embodiment as shown in FIG. 5D, the method includes, in response to the bristles of the sweep broom 3 wearing, moving the sweep broom 3 toward the surface G and moving the guide assembly 6 and the collecting container 11 towards the sweep broom 3. The respective moving of the sweep broom 3, guide assembly 6, and rear guide 12 maintain a uniform space between the sweep broom 3 and the guide assembly 6, and maintain a uniform space between the sweep broom 3 and the collecting container 11.

In yet another embodiment, the method includes, in response to the bristles of the sweep broom 3 becoming worn, moving the sweep broom 3 toward the surface G and towards the guide assembly 6 so as to maintain a uniform space between the sweep broom 3 and the guide assembly 6, and moving the collecting container 11 towards the guide assembly 6 so as to maintain a uniform space between the sweep broom 3 and the collecting container 11.

In further embodiments, the distance between the guide assembly 6 and the broom 3 may be set by the user, and based on the size of the debris to be collected. For example, if the debris to be collected is relatively large, a greater distance between the guide assembly 6 and the broom 3 may be set by the user. Likewise, if the debris to be collected is relatively small, a smaller distance between the guide assembly 6 and the broom 3 may be set by the user.

While an exemplary embodiment has herewith been described, the present invention is not limited to this preferred embodiment, but comprises any and all the embodiments having equivalent elements, changes, omissions, combinations, adaptations and/or alterations as they would be considered by those skilled in the art based on the present description. For example, the materials used to realize the various components of the leverage 4, broom support 2, pantograph 5, guide assembly 6 are preferably metal, but they can also be plastic particularly suitable to resist wearing, such as plastic material reinforced with carbon fiber. The movement of sweep broom 3 and guide assembly 6 and rear guide 12 and collecting container 11 may be controlled by any suitable linkage. For example, the movement of guide assembly 6 and rear guide 12 or collecting container 11 may be linked mechanically to the movement of the sweep broom 3, or movement may be controlled separately with independent linkages, and movement may be controlled by for example manual adjustment or actuator or electric motor as would be understood by those skilled in the art. The forms and dimensions of each piece or component may vary according to particular constructive or dimensional requirements in order to adapt the device to motor-sweepers for instance with or without an operator. It is therefore intended that all such modifications are embraced within the scope of the embodiments as defined in the appended claims.

The invention claimed is:

1. A method for collecting garbage from a surface, the method comprising:

providing a motor-sweeper including (i) a sweep broom for conveying garbage into a collecting container located behind the sweep broom with respect to a forward direction of the motor-sweeper, and (ii) a garbage guide assembly covering the sweep broom in order to be proximal to a front of the sweep broom and the guide assembly extending to the collecting container;

providing a rear guide between the sweep broom and the collecting container, the rear guide extending downwards close to the sweep broom;

resting the sweep broom with the guide assembly onto the surface;

rotating the sweep broom to collect and convey the garbage into the collecting container, the rotation of the sweep broom causing the garbage to be swept forwardly and upwardly with respect to a forward motion of the motor-sweeper in the forward direction; and in response to bristles of the sweep broom becoming worn, moving the sweep broom toward the surface and moving the guide assembly towards the sweep broom so as to (i) maintain a uniform space between the sweep broom and the guide assembly, and (ii) moving the rear guide so as to maintain a uniform space between the sweep broom and the rear guide.

2. The method according to claim 1, wherein the steps of moving the sweep broom, the guide assembly, and the rear guide are performed simultaneously.

3. The method according to claim 2, wherein the steps of moving the sweep broom, the guide assembly, and the rear guide are performed in response to a single command.

4. A method for collecting garbage from a surface, the method comprising:

providing a motor-sweeper including (i) a sweep broom for conveying garbage into a collecting container located behind the sweep broom with respect to a forward direction of the motor-sweeper, and (ii) a garbage guide assembly covering the sweep broom in order to be proximal to a front of the sweep broom and the guide assembly extending to the collecting container;

providing a rear guide between the sweep broom and the collecting container, the rear guide extending downwards from the collecting container close to the sweep broom;

resting the sweep broom with the guide assembly onto the surface;

rotating the sweep broom to collect and convey the garbage into the collecting container, the rotation of the sweep broom causing the garbage to be swept forwardly and upwardly with respect to a forward motion of the motor-sweeper in the forward direction; and in response to bristles of the sweep broom becoming worn, (i) moving the sweep broom toward the surface and towards the guide assembly so as to maintain a uniform space between the sweep broom and the guide assembly, and (ii) moving the rear guide towards the guide assembly so as to maintain a uniform space between the sweep broom and the rear guide.

5. The method according to claim 4, wherein the steps of moving the sweep broom and the rear guide are performed simultaneously.

6. The method according to claim 5, wherein the steps of moving the sweep broom and the rear guide are performed in response to a single command.

7. A method for collecting garbage from a surface, the method comprising:

providing a motor-sweeper including (i) a sweep broom for conveying garbage into a collecting container located behind the sweep broom with respect to a forward direction of the motor-sweeper, and (ii) a garbage guide assembly covering the sweep broom in order to be proximal to a front of the sweep broom and the guide assembly extending to the collecting container;

resting the sweep broom with the guide assembly onto the surface;

rotating the sweep broom to collect and convey the garbage into the collecting container, the rotation of the sweep broom causing the garbage to be swept forwardly and upwardly with respect to a forward motion of the motor-sweeper in the forward direction; and in response to the bristles of the sweep broom wearing, moving the sweep broom toward the surface and moving the guide assembly towards the sweep broom so as to maintain a uniform space between the sweep broom and the guide assembly, and moving one or the other of the sweep broom or the rear guide so as to maintain a uniform space between the sweep broom and the collecting container.

8. A method for collecting garbage from a surface, the method comprising:

providing a motor-sweeper including (i) a sweep broom for conveying garbage into a collecting container located behind the sweep broom with respect to a forward direction of the motor-sweeper, and (ii) a garbage guide assembly covering the sweep broom in order to be proximal to a front of the sweep broom and the guide assembly extending to the collecting container;

resting the sweep broom with the guide assembly onto the surface;

rotating the sweep broom to collect and convey the garbage into the collecting container, the rotation of the sweep broom causing the garbage to be swept forwardly and upwardly with respect to a forward motion of the motor-sweeper in the forward direction; and in response to bristles of the sweep broom becoming worn, (i) moving the sweep broom toward the surface and towards the guide assembly so as to maintain a uniform space between the sweep broom and the guide assembly, and (ii) moving the collecting container towards the guide assembly so as to maintain a uniform space between the sweep broom and the collecting container.

9. An apparatus for collecting garbage for a motor-sweeper, the apparatus comprising:

a sweep broom support rotatably supported onto a first bar connected to a body of the motor-sweeper;

a sweep broom mounted onto the sweep support such that the sweep broom has a rotating axis parallel to a surface to be cleaned;

a collecting container configured to collect garbage, the collecting container being positioned behind the sweep broom with respect to a forward direction of the motor-sweeper;

a rear guide between the sweep broom and the collecting container, the rear guide extending from the collecting container downwards and proximal to the sweep broom;

a leverage assembly acting on the support to regulate the distance of the sweep broom from the surface;

a motor configured to activate the sweep broom;

a guide assembly connected to the collecting container configured to guide the garbage collected by the sweep broom towards the collecting container; and a rear guide assembly in communication with the rear guide to regulate the distance of the rear guide to the sweep broom;

wherein:

in response to bristles of the sweep broom becoming worn, the leverage assembly commands the sweep broom support to move the sweep broom towards the surface to be cleaned, the rear guide assembly commands the rear guide to move towards the sweep broom, and the guide assembly follows the movement of the sweep broom, so as to maintain a uniform space between the sweep broom and the guide assembly and to maintain a uniform space between the sweep broom and the rear guide.

10. The apparatus according to claim 9, wherein:

the guide assembly includes a flap contacting the surface, which flap is close to the sweep broom and opposite to the collecting container, a connecting portion between the flap and a guiding portion of the guide assembly, the guide assembly is bound directly or indirectly to the frame of the motor-sweeper, and the connecting portion has a first side fixed onto the flap and a second side scraping against a surface of the guiding portion so that to provide a surface that can be adapted without interruptions to the movement of the sweep broom.

11. The apparatus according to claim 9, wherein the sweep broom support includes a first side and a second side parallel each other and joined by the first bar in correspondence of respective first portions, and by a second bar in correspondence of respective second portions, the first side being provided with a third portion hinged to rotate and allowing the removal of the sweep broom and the second side being formed in order to sustain the motor.

12. The apparatus according to claim 9, wherein the leverage assembly includes a damper to absorb the bumps received by the apparatus.

13. An apparatus for collecting garbage for a motor-sweeper comprising:

a sweep broom support moveably connected to a body of the motor-sweeper;

a sweep broom mounted onto the sweep support such that the sweep broom has a rotating axis parallel to a surface to be cleaned;

a collecting container configured to collect garbage, the collecting container being positioned behind the rotating sweep broom with respect to a forward direction of the motor-sweeper;

a rear guide between the sweep broom and the collecting container, the rear guide extending downwards and proximal to the sweep broom;

a leverage assembly acting on the support to regulate the distance of the sweep broom from the surface to be cleaned;

a motor configured to activate the sweep broom;

a guide assembly configured to guide the garbage collected by the sweep broom towards the collecting container;

wherein:

in response to bristles of the sweep broom becoming worn, the leverage assembly commands the sweep broom support to move the sweep broom towards the surface to be cleaned so as to maintain a uniform space between the sweep broom and the guide assembly, and to maintain a uniform space between the sweep broom and the rear guide.

* * * * *